US005232098A

United States Patent [19]

St-Pierre et al.

[11] Patent Number: 5,232,098

[45] Date of Patent: Aug. 3, 1993

[54] SCREENING APPARATUS FOR EFFICIENTLY SEPARATING COARSE MATERIAL FROM FINER MATERIAL

[75] Inventors: Jean-Guy St-Pierre; André Godbout, both of Plessisville, Canada

[73] Assignee: Les Equipements Vibrotech Inc., Canada

[21] Appl. No.: 857,242

[22] Filed: Mar. 25, 1992

[51] Int. Cl.[5] ..... B07B 1/00

[52] U.S. Cl. ..... 209/240; 209/243; 209/316; 209/366.5

[58] Field of Search ..... 209/240, 241, 243, 244, 209/245, 246, 248, 315, 316, 420, 421, 366.5, 367

[56] References Cited

U.S. PATENT DOCUMENTS

| | | | |
|---|---|---|---|
| 2,640,592 | 6/1949 | Finger . | |
| 2,836,298 | 5/1958 | Tobin . | |
| 3,372,806 | 4/1966 | Porter . | |
| 3,729,087 | 4/1973 | Bruns . | |
| 4,177,900 | 12/1979 | Kluthe . | |
| 4,190,526 | 2/1980 | Bachand . | |
| 4,197,194 | 4/1980 | Read | 209/421 |
| 4,256,572 | 3/1981 | Read . | |
| 4,363,725 | 12/1982 | Morita et al. | 209/421 |
| 4,493,767 | 1/1985 | Monteyne . | |
| 4,609,405 | 9/1986 | Elliott . | |
| 4,956,078 | 9/1990 | Magerowski . | |
| 5,082,555 | 1/1992 | Read . | |
| 5,106,490 | 4/1992 | McDonald | 209/240 |

*Primary Examiner*—H. Grant Skaggs

*Attorney, Agent, or Firm*—Eckert Seamans Cherin & Mellott

[57] ABSTRACT

The screening apparatus for efficiently separating coarse material from finer material, comprises a frame having a lower portion for resting on a surface, and a higher portion; a vibrating screen unit including a first material separating screen having a lower edge sloping downward with respect to said surface, and supported by the frame between the lower and higher portions; a shaker attached onto the vibrating screen unit for shaking the vibrating screen unit; a pivoting skip sufficiently wide for accommodating a payloader shovel, having two side arms pivotally connected onto the higher portion of the frame at a level that is sufficiently low for accommodating the payloader shovel; and a vibrator unit connected onto the skip. The apparatus also comprises at least one hydraulic cylinder having a first end connected onto the frame, and a second end connected onto the skip so that the skip can be vibrated and gradually pivoted with respect to the frame, by activating the vibrator unit and the at least one cylinder from a first position in which the skip can be loaded with material into a second position in which the material loaded in the skip can be unloaded over said screen.

8 Claims, 7 Drawing Sheets

SCREENING APPARATUS FOR EFFICIENTLY SEPARATING COARSE MATERIAL FROM FINER MATERIAL

BACKGROUND OF THE INVENTION

The present invention relates to a screening apparatus for efficiently separating coarse material from finer material.

More specifically, the present invention relates to a screening apparatus for separating certain types of material such as earth, sand, bits of gravel, etc. With several screening apparatus known in the art, the material is trapped onto a vibrating screen. The screen has meshes having a specific size according to the screening that is desired. Normally, the material is screened two or three times to maximize the quality of the end product. Also, In many cases, a hopper is provided at the entry of the screening apparatus.

There is a great demand for earth material. As the cost of transport is increasing, the merchant tries to treat the earth material on the spot. Then, the ground is excavated, and the earth is led down directly onto the vibrating screen. In many cases, the material that is screened has to be classified. In certain cases, during the screening operation, components are added to the screened material.

It has to be noted that most of the screening apparatus are very big and are mounted on wheels or on trucks with hoppers. It is difficult to move these screening apparatus. Also, these big screening apparatus have sometimes problems when they are loaded with material containing stump, wood or big rocks that can block the operation of the screening apparatus.

Known in the art, there is the U.S. Pat. No. 5,082,555, granted on Jan. 21, 1992. This patent describes a soil feeder apparatus for use above an angled screen soil separating apparatus and adapted to feed soil material to be separated over a time period onto the angled screen of the soil separating apparatus. The apparatus comprises a hopper body having walls defining a space within the hopper body to receive soil material; means to tilt the hopper body about an axis; timing means to activate the means to tilt for a defined time period and to return rapidly the hopper body to a generally horizontal position; and a bracket means to mount the hopper body on the separating apparatus. When operating this apparatus, it has been found that it operates correctly only when the soil material to be separated is very dry. When the soil material is wet, it sticks on the bottom surface of the hopper body to a point where the apparatus does not operate efficiently at all.

Known in the art, there is also the U.S. Pat. No. 4,256,572 granted on Mar. 17, 1991. This patent describes a portable screening apparatus for separating coarse material from finer material. It comprises a material separating shaker screen sloping downward from near the upper edge of the tall end of the frame to near the upper edge of the short end of the frame; an outfeed conveyor extending from within the frame through one of the sides to carry finer material out of the frame; and means for directing finer material which falls through the shaker screen to the conveyor. One drawback with the above-mentioned apparatus is that there is no means for regulating the feeding of material to be screened onto the shaker screen.

Also known in the art, there are the U.S. Pat. No. 4,956,078 granted on Sep. 11, 1990; U.S. Pat. No. 4,609,405 granted on Sep. 2, 1986; U.S. Pat. No. 4,190,526 granted on Feb. 26, 1980; and U.S. Pat. No. 3,729,087 granted on Apr. 24, 1973 which relate to different kinds of hopper or diffuser for granular material. None of the above patents provide an efficient and simple solution for regulating the feeding of the material to be screened onto the material separating shaker screen of the apparatus shown in the U.S. Pat. No. 4,265,572.

Also known in the art, there are the U.S. Pat. No. 4,493,767 granted on Jan. 15, 1985; U.S. Pat. No. 4,177,900 granted on Dec. 11, 1979; U.S. Pat. No. 3,372,806 granted on Mar. 12, 1968; U.S. Pat. No. 2,836,298 granted on May 27, 1958; and U.S. Pat. No. 2,640,592 granted on Jun. 2, 1953 which relate to different kinds of conveyors. None of the above-mentioned patents provide an efficient and simple solution for regulating the feeding of the material to be screened onto the shaker screen of the apparatus shown in the U.S. Pat. No. 4,256,572.

An object of the present invention is to provide a screening apparatus that is provided with means for regulating the feeding of the material to be screened onto its shaker screen so that an efficient screening can be performed even when the material contains big unwanted objects such as stomp or big rocks, or even if the material is wet.

SUMMARY OF THE INVENTION

According to the present invention, there is provided a screening apparatus for efficiently separating coarse material from finer material, comprising:

a frame having a lower portion for resting on a surface, and a higher portion;

a vibrating screen unit including a first material separating screen having a lower edge sloping downward with respect to said surface, and supported by said frame between said lower and higher portions;

shaking means attached onto said vibrating screen unit for shaking said vibrating screen unit;

a pivoting skip sufficiently wide for accommodating a payloader shovel, having two side arms pivotally connected onto said higher portion of said frame at a level that is sufficiently low for accommodating said payloader shovel;

at least one hydraulic cylinder having a first end connected onto said frame, and a second end connected onto said skip so that said skip can be gradually pivoted with respect to said frame, by activating said at least one cylinder from a first position in which said skip can be loaded with material into a second position in which said material loaded in said skip can be unloaded over said screen; and a vibrator unit connected onto said skip; whereby by pivoting gradually said skip loaded with material and activating said vibrator unit, said vibrating screen unit can be gradually fed to produce an efficient screening and prevent blocking of said screening unit.

The objects, advantages and other features of the present invention will become more apparent upon reading of the following non restrictive description of a preferred embodiment thereof, given for the purpose of exemplification only with reference to the accompanying drawings.

DETAILED DESCRIPTION OF THE DRAWINGS

Figure 1:
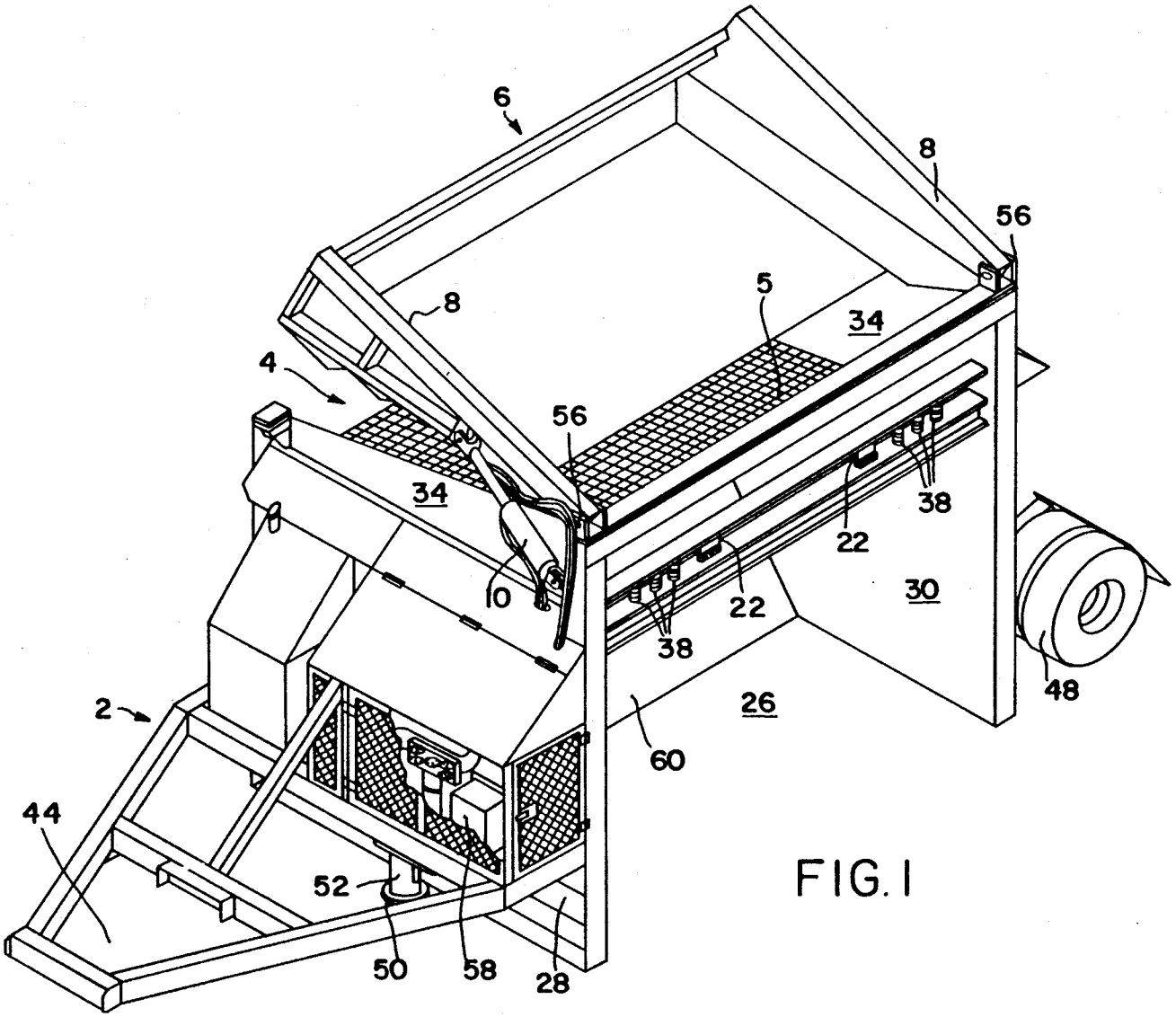
FIG. 1 is a perspective view from above illustrating the screening apparatus in accordance with the present invention.

Referring now to FIG. 1, there is shown a screening apparatus for efficiently separating coarse material from finer material. This apparatus comprises a frame 2 having a lower portion for resting on the ground, and a higher portion. The vibrating screen unit 4 includes a first material separating screen 5 having a lower edge sloping downward with respect to the ground, and supported by the frame 2 between the lower and higher portions. A shaking means which is formed of a hydraulic motor 7 is attached onto the vibrating screen unit 4 for shaking it. This shaking means 7 is similar to the one 14 shown in FIGS. 2, 3, 4 and 5.

The pivoting skip 6 is sufficiently wide for accommodating a payloader shovel. It has two side arms 8 pivotally connected onto the higher portion of the frame 2 at a level that is sufficiently low for accommodating the payloader shovel. Two hydraulic cylinders 10 have respectively a first end connected onto the frame 2, and a second end connected onto the skip 6 so that it can be gradually pivoted with respect to the frame 2, by activating the cylinders 10 from a first position in which the skip can be loaded with material into a second position in which the material loaded in the skip 6 can be unloaded over the screen 5, whereby by pivoting gradually the skip 6 loaded with material, the vibrating screen unit 4 can be gradually fed to produce an efficient screening and prevent a blocking of the screening unit 4.

The vibrating screening unit 4 further comprises a second material separating screen 12 having a lower edge sloping downward with respect to the ground. The second screen 12 is supported by the frame 2 underneath the first material separating screen 5. The second screen 12 has meshes that are smaller than the ones of the first screen 5 to produce a finer screening. The second screen 12 is substantially parallel to the first screen 5, whereby finer material is screened a second time by the second screen 12 so that only finest material passes through the second screen 12. Material that is rejected by the second screen 12 falls at its lower edge.

The two hydraulic cylinders 10 have their first end connected respectively on opposite sides of the frame 2, and their second end connected respectively along the side arms 8. A hydraulic vibrator unit 14 is connected onto the skip 6.

Figure 3:
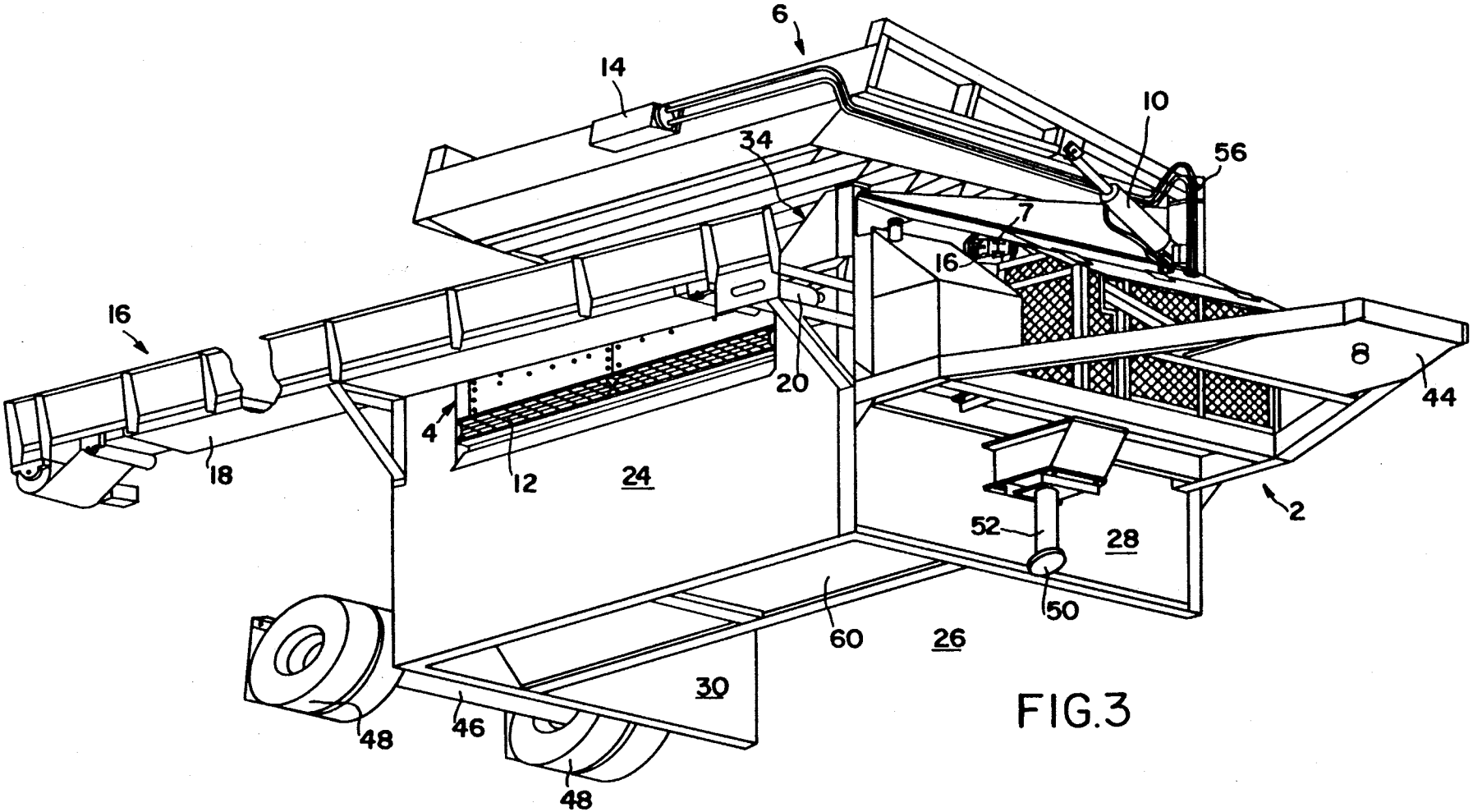
FIG. 3 is a perspective view from under illustrating the screening apparatus shown in FIGS. 1 and 2, equipped with a transversal longitudinal conveyor.

Referring now more specifically to FIG. 3, there is shown a transversal longitudinal conveyor 16 that comprises a conveying strap 18 that is adjacent to the lower edge of the first screen 5 so that coarse material rejected by the first screen 5 can fall off from its lower edge onto the conveying strap 18 to be conveyed at a remote location. A motor 20 is provided for activating the strap 18, whereby material that is rejected from the screen 5 can be separated from material rejected from the second screen 12.

Referring now more specifically to FIG. 1, there are shown rubber shock absorbers 22 connected between the vibrating screen unit 4 and the frame 2 to absorb an amplifying effect resulting from a natural frequency resonance of the vibrating screen unit 4.

Referring again to FIGS. 1, 2 and 3, the screening apparatus has a frame 2 of rectangular form. The frame 2 has a lower side closed by wall 24 and an opposite side that is open. The frame 2 is also provided with front and back walls 28 and 30. The side, front and back walls 24, 28 and 30 form a space 26 where the finest material is received after a screening. The upper portion of the frame 2 is funnel-shaped, and comprises bias walls 34 to gather material dropped from the skip 6. The vibrating screen unit 4 is supported by the frame 2 underneath the bias walls 34.

The upper screen 5 has meshes of a size allowing separation of big objects from the material. The lower screen 12 has meshes that are smaller than the ones of the upper screen 5 to screen the remaining material that has passed through the upper screen 5. As shown in FIG. 1, the vibrating screen unit 4 is supported at the back and at the front by means of suspension springs 38. The vibrating unit 4 is allowed to vibrate because it is supported by the suspension springs, and is put into vibration by the rotation of an unbalanced shaft provided with counterweights that is connected to the shaft of the hydraulic motor 7. These counterweights are fixed on air wheels that are situated at opposite ends of the unbalanced shaft. The hydraulic motor 7 is mounted on a support plate, and is connected via a coupling to the unbalanced shaft.

The inferior portion of reservoir 40 comprises hydraulic fluid to feed the hydraulic motor 7. The superior portion of the reservoir 40 comprises diesel oil to feed the four-cylinders diesel motor that is installed in the compartment 42.

The hydraulic motor 7 is directly fixed onto the vibrating unit 4 and is connected to a hydraulic control by means of resilient pipes. To move the present screening apparatus, a fifth wheel is provided at the front end of the frame 2. The rear part of the frame 2 is provided with an axel 46 with double wheels 48 at each of its opposite ends.

Before operating the present apparatus, the rear axel 46 is lifted upward with the cylinder 52 so that the apparatus rests on the ground on its frame 2. When the apparatus has to be moved, the hydraulic cylinder 52 is extended, and the rear axel 46 is moved downward so that the apparatus rests at the back on its wheels 48 and at the front on the foot 50 of the hydraulic cylinder 52.

The hydraulic cylinder 50 is used for fixing the attaching plate 44 onto the hook of a vehicle. When the rear axel 46 is moved downward, the frame is lifted about ten inches above the ground so that the apparatus can be moved as a trailer.

The pivoting skip 6 is used for feeding the vibrating screen unit 4 with material. The pivoting skip 6 is installed onto the higher portion of the frame 2, and is attached onto the frame by means of two pivots 56 disposed on each side of the higher portion of the frame 2.

Figure 4:
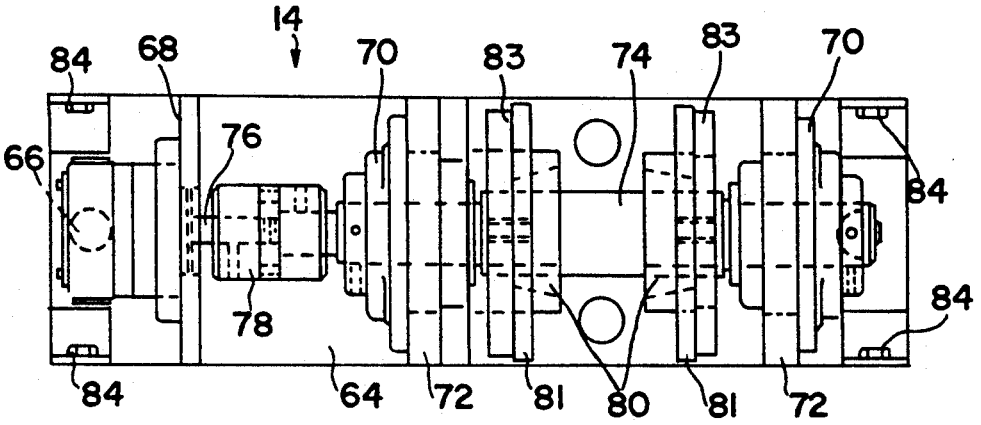
FIG. 4 is a view from above of the hydraulic vibrating unit that can be seen on FIGS. 2 and 3.
Figure 5:
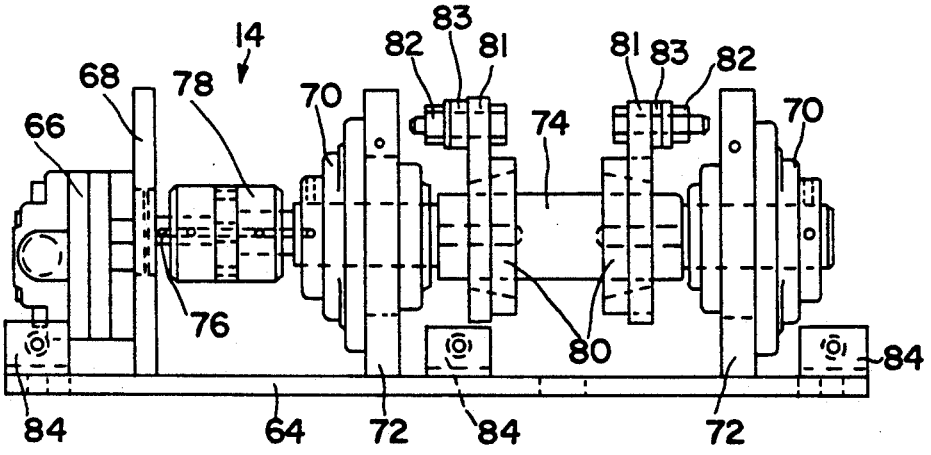
FIG. 5 is a side view of the hydraulic vibrator unit shown on FIG. 4.

This pivoting skip 6 may be of different sizes. The pivoting skip 6 is activated by means of two hydraulic cylinders 10 which can lift the skip 6 at different heights by means of the programmed controller 58. The pivoting skip 6 is equipped with the hydraulic vibrator unit 14 fixed onto the moving side of the skip 6. This vibrator unit 14 produces an intense vibration resulting from the rotation of an unbalanced shaft. Counterweights are fixed onto the unbalanced shaft by means of air wheels as shown in FIGS. 4 and 5.

With this pivoting skip 6, the content of the payloader is not unloaded in one time onto the vibrating screening unit 4. Also, this pivoting skip 6 can be remotely controlled so that the operator of the payloader can activate himself the beginning of the unloading of the pivoting skip 6 onto the vibrating unit 4. During the time period when the pivoting skip is unloaded onto the vibrating unit 4, the payloader can go for another load of material to be screened. Alternatively, the operator of the payloader can start to remove the material that has been screened when the pivoting skip 6 is unloading.

The lateral conveyor 16 is fixed onto the frame 2, underneath the lower edge of the upper screen 5. By means of this conveyor 16, the material that is rejected by the upper screen can be conveyed to a remote location. With this conveyor 16, the present apparatus can produce two kinds of screened material that can be exploited commercially. The first product, which is the finest product, can be found right underneath the screening apparatus. The second product that has been screened by the upper screen 5 but rejected by the lower screen 12, can be found nearby the side of the frame where are the lower edges of the screens. With this conveyor 16, it is easier to obtain different kinds of products, in one operation, that can be used commercially.

Also, the present apparatus is provided with rubber shock absorbers 22 to reduce the noise that is generated when the vibrating unit 4 is turned on or turned off. These rubber shock absorbers are made of thick and strong rubber that reduce considerably excessive noise and possibilities of hammering of different components of the apparatus.

In accordance with the portable aspect of the present invention, the frame 2 has a shape that is substantially rectangular with a higher side and a lower side. The frame is provided with a lateral wall 24 on its lower side, and is open on the higher side. An inside bias plate 60 is fixed between the front and back walls 28 and 30 of the frame 2, to project falling material from the screening unit 4 toward the opening of the frame so that removing of the screened material by means of the payloader is easier. Also, three bias surfaces 34 are provided on the upper portion of the frame 2, above and around the screening unit 4 to form a funnel by which material to be screened is directed toward the screening unit 4.

The rear axel 46, that supports two pairs of double wheels 28, is movable between two positions. This axel 46 can be moved downward to support the apparatus when it has to be displaced, or can be moved upward so that the frame 2 can rest directly on the ground. This rear axel 46 is moved by means of a hydraulic cylinder. The double wheels 28 are positioned at the back of the frame, and the attaching plate 44 is positioned at the front of the frame 2. The power supply of the apparatus is installed in the front portion of the frame 2.

Referring now to FIGS. 4 and 5, there is shown the hydraulic vibrator unit 14. This unit 14 comprises a plate 64 by which the unit 14 is connected onto the skip (not shown in these FIGS. 4 and 5), a hydraulic motor 66 mounted onto the plate 64 by means of a plate support 68, two roll bearings 70 mounted respectively onto the plate 64 by means of plate supports 72, a command shaft 74 supported by the roll bearings 70 and connected to the shaft 76 of the hydraulic motor 66 by means of a resilient coupling 78, and two counterweights 81 having hub portions 80 of conical shape, fixed around the command shaft 74, onto which additional counterweights 83 are fixed by means of fixing bolts 82, whereby an unbalanced effect can be produced. As it can be seen in FIGS. 2 and 3, this hydraulic vibrator unit 14 is provided with a lid (not shown in FIGS. 4 and 5) that is fixed onto the plate 64 by means of support plates 84.

The object of this hydraulic vibrator unit 14 is to make easier and regular the unloading of material from the pivoting skip 6 onto the vibrating screen unit 4. Preferably, this hydraulic vibrator unit 14 is operating only during the rest period of the skip after a lifting period.

Figure 2:
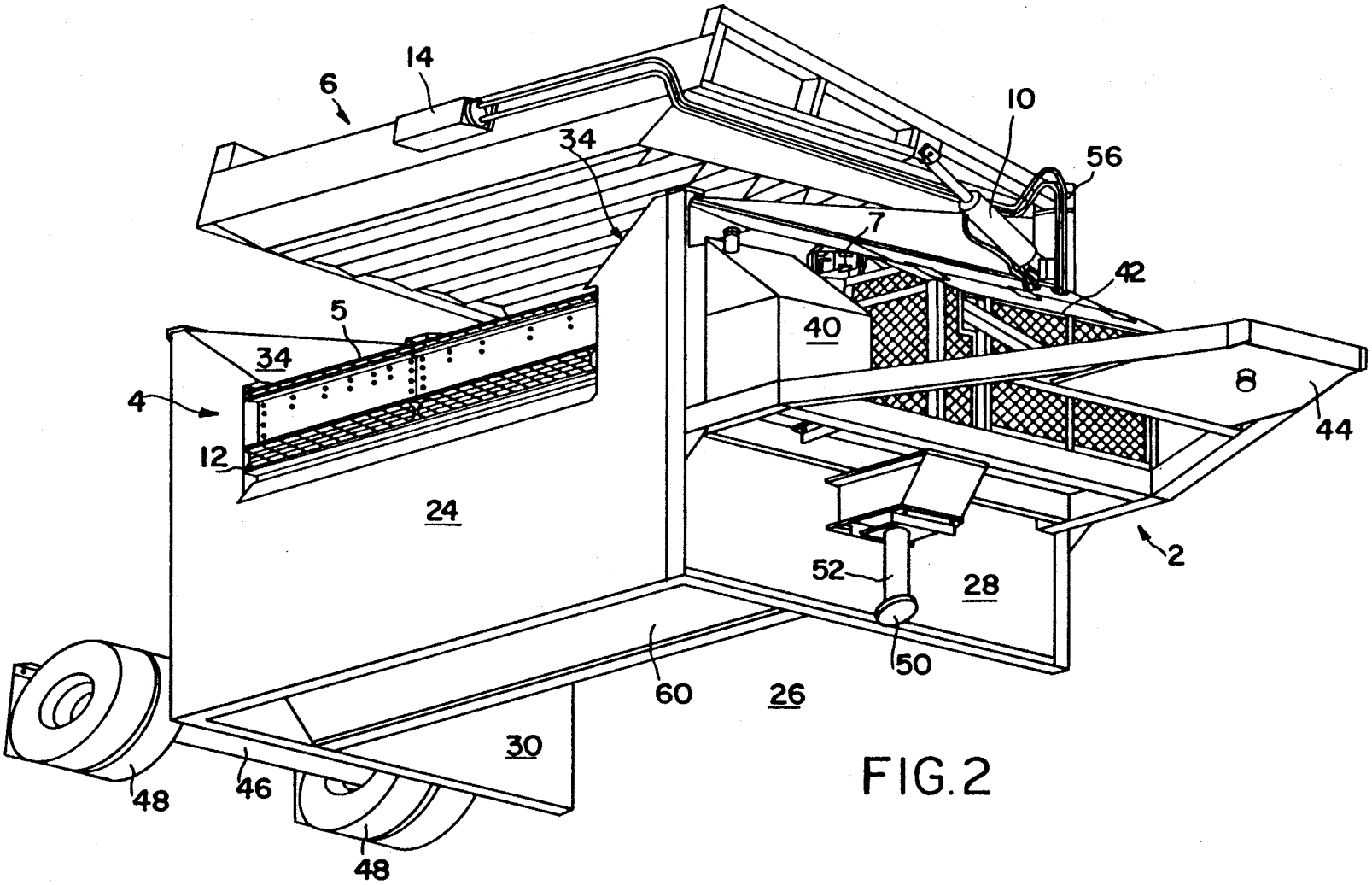
FIG. 2 is a perspective view from under illustrating the screening apparatus shown in FIG. 1.
Figure 6:
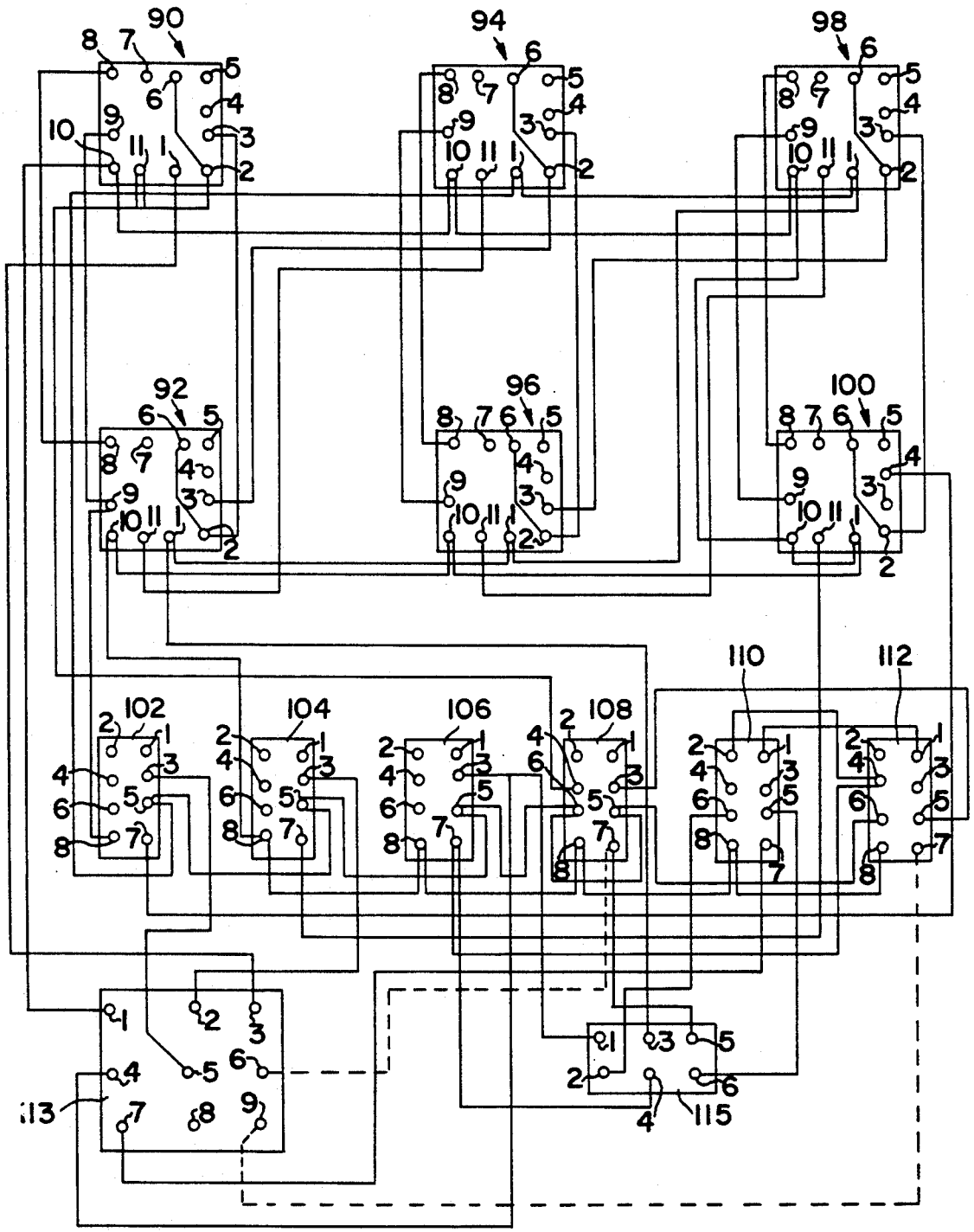
FIG. 6 is a block diagram illustrating the timer control box of the program controller in accordance with the present invention.

Referring now to FIG. 6, there are shown the elements of the timer control box of the program controller for controlling activation of the hydraulic cylinders 10 shown on FIGS. 1, 2 and 3. This timer control box comprises a first timer 90 for selecting a first lifting time period of the skip, a second timer 92 for selecting a first rest time period of the skip that follows the first lifting period, a third timer 94 for selecting a second lifting time period of the skip that follows the first rest period, a fourth timer 96 for selecting a second rest time period of the skip that follows the second lifting time period, a fifth timer 98 for selecting a third lifting period that follows the second rest time period, a sixth timer 100 for selecting a third rest time period that follows the third lifting time period, six relays 102, 104, 106, 108, 110 and 112 connected respectively to timers 90, 92, 94, 96, 98 and 100, for controlling the two hydraulic cylinders 10 (shown on FIGS. 1, 2 and 3) upon activation of the timers 90, 92, 94, 96, 98 and 100, whereby the controller can be programmed by an operator that manually sets these timers.

Figure 8:
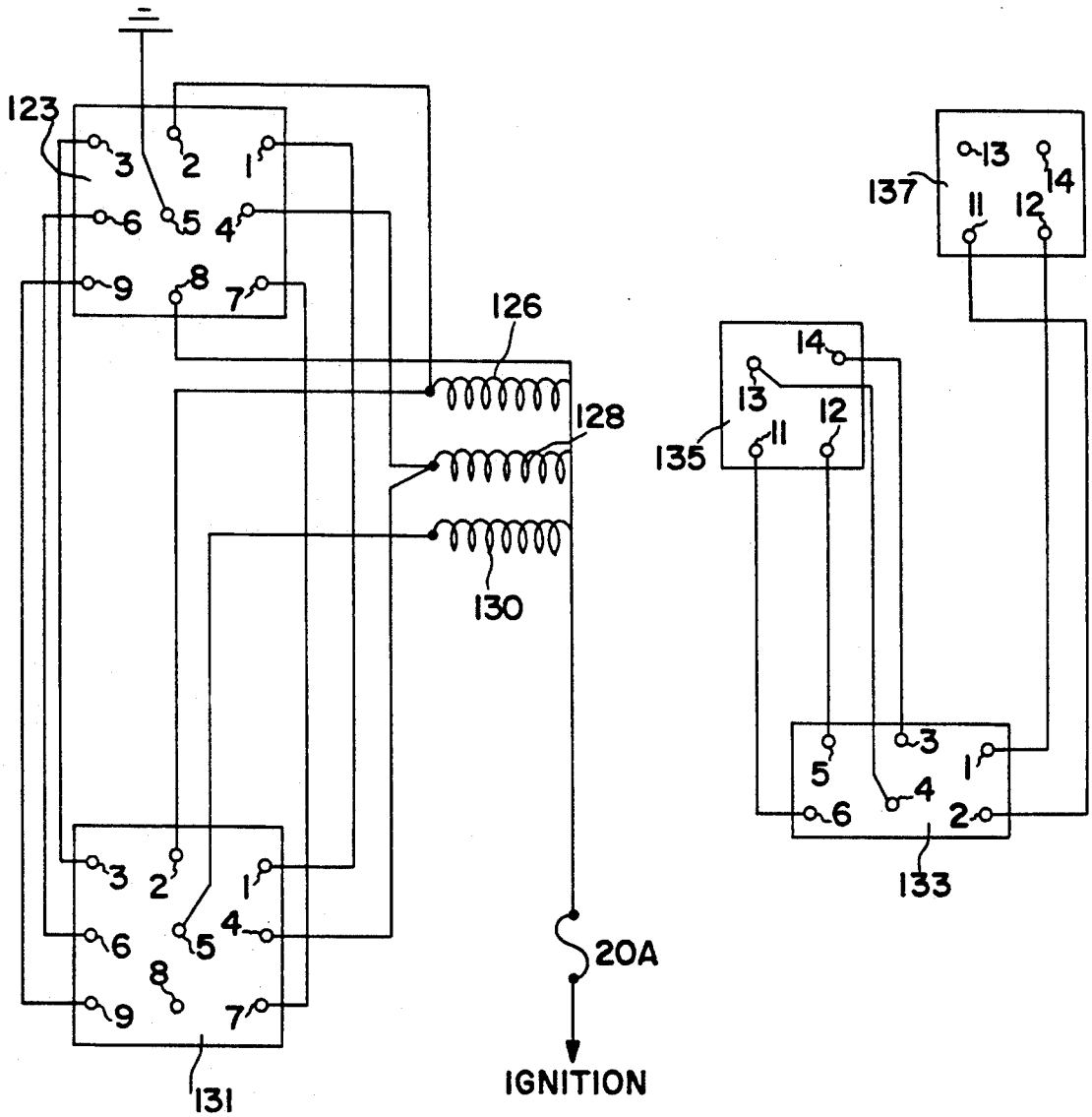
FIG. 8 is another block diagram illustrating the remaining elements of the program controller.

The timer control box is connected to other elements of the program controller shown in FIG. 8 via a nine pin connector 113 that is connected to the nine pin connector 131 shown in FIG. 8, and via a six pin connector that is connected to the six pin connector 133 shown in FIG. 8.

The timers 90, 92, 94, 96, 98 and 100 are connected to the hydraulic cylinders that control the pivoting skip by means of relays 102, 104, 106, 108, 110 and 112. The object of the timer 90 is to set the first lifting period of the pivoting skip so that it stops at a first desired height. The object of the second timer 92 is to maintain the pivoting skip during a predetermined time at this desired height and, if needed, to turn on the hydraulic vibrator unit. The timer 94 is provided for adjusting the second lifting time period of the pivoting skip and to stop it at a second desired height. The fourth timer 96 is provided to maintain the pivoting skip at this second desired height. The fifth timer 98 is provided for setting the third lifting time period of the pivoting skip and to stop it at a third desired height. The sixth timer 100 is provided to set the timer period during which the pivoting skip is maintained at the third desired height before the last lifting of the pivoting skip until it reaches its final height before it is brought back to its lower starting position where it is ready to receive a new load of material.

Figure 7:
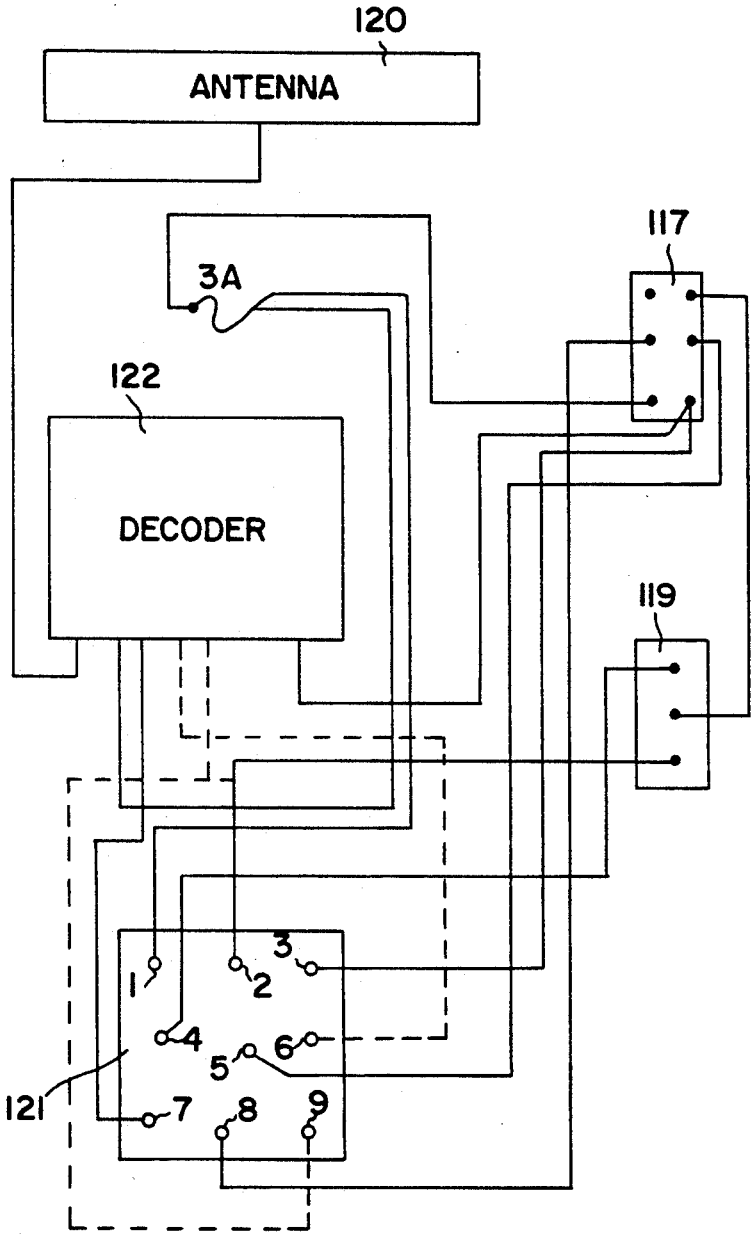
FIG. 7 is another block diagram illustrating the decoder control box of the program controller.

Referring now to FIG. 7, there is shown the elements of the decoder control box of the program controller, which comprises an antenna 120 for receiving a remote command signal, and a decoder 122 connected to the antenna 120 for decoding the remote signal and produce a command signal for the controller, whereby the controller can be activated by an operator situated at a remote location.

The decoder control box also comprises a main control switch 117 for selecting the mode of operation of the apparatus. This switch 117 is a three position switch 117 by which an operator can select a manual operation mode or an automatic operation mode, or turn off the apparatus. A manual switch 119 is provided for lowering or lifting the skip when the switch 117 is set on manual operation mode. The decoder control box is connected to other elements of the program controller shown in FIG. 8 via a nine pin connector 121 that is connected to the nine pin connector 123.

Referring now to FIG. 8, there is shown the remaining elements of the program controller. The control coils 126, 128 and 130 control respectively a lifting of the pivoting skip, a lowering of the skip and an activation of the hydraulic vibrator unit.

As indicated above, the connectors 131 and 133 are connected to the timer control box shown in FIG. 6, and the connector 123 is connected to the decoder control box shown in FIG. 7. The switch 135 triggers the end of the lifting stroke of the skip to stop it, and start its lowering when the switch 117 shown in FIG. 7 is set on automatic operation mode. The switch 137 triggers the end of the lowering stroke of the skip to stop it when the switch shown in FIG. 7 is set on automatic operation mode.

If the operator wants to screen fine sands for producing mortar, the period of time needed for screening a load of the pivoting skip is much longer than the one needed for producing a material of particles having larger sizes. The programmed controller connected to the pivoting skip provides the possibility to program in advance the first lifting of the skip from a point A to a point B, to program a rest time for the skip at this point B, to produce a second lifting from the point B to a point C, to program a second rest time of the skip at this point C, to program third lifting of the skip from the point C to a point D, to program a third rest period of the skip at this point C and then to activate a last lifting of the skip until it reaches the upper stroke switch which then generates a command signal to lower the skip to point A or until the skip reaches the lower stroke switch to stop it. The skip will rest at point A until a new sequence is started by the operator.

As the material to be screened can vary from one day to the other, either by a temperature change or because the material is dry or wet, it is very useful to be able to modify the lifting sequence of the pivoting skip. The program controller can be adjusted so that there is no rest time during the lifting of the skip, or so that one, two or three rest time periods are selected by the operator. Also, by means of the program controller, each rest time period and the height at which the skip is positioned during each rest period can be programmed.

In operation, a load of material to be screened is unloaded from a payloader into the pivoting skip. As soon as the payloader is empty, the operator pushed a button on its remote control to activate a full cycle of the pivoting skip according to the pre-established sequence.

Then, the skip is lifted to a first height for a certain time period during which the vibrator unit is activated to produce a regular unloading of the material onto the vibrating screen unit, afterwards the skip is lifted to a second desired height to drop more material from the skip onto the vibrating unit and so on.

The material that is unloaded from the skip is directed onto the upper screen of the vibrating screen unit by means of bias surfaces The vibration of the vibrating screen unit shakes the material which separates itself into particles and are screened through the upper and lower screens. Material that is rejected by the upper screen moves toward the lower edge of the upper screen and is dropped onto the conveying strap of the conveyor. The material that is screened by the upper screen but rejected by the second lower screen is dropped at the lower edge of the lower screen and falls on the ground. The material that is screened by the two screens falls on the ground in the enclosure defined by the frame. This enclosure formed by the frame prevents the material to be blown away by the wind. When the accumulation of screened material in the enclosure is sufficient, the payloader can remove the material from the enclosure. This enclosure should be sufficiently wide and high to allow movements of the shovel of the payloader inside the enclosure. The open side of the frame which defines the entry to the enclosure should be sufficiently high to allow an efficient operation by the shovel of the payloader. Preferably, the height of the open side varies from 6 to 8 feet, which depends upon the size of the payloader.

To obtain an efficient operation of the apparatus, it is also important that the slope of the screens be adequate because if the slope is too low, the rejection material will take too much time to reach the lower edges of the screens which will reduce the unloading of the rejected material and at the same time the efficiency of the apparatus. But, if the slope is too high, the material will move too rapidly toward the lower edges of the screens and a good portion of good material will be rejected before the screening. Also, in the latter case, the rejected material which can be used for certain applications will be contaminated by unwanted material. Preferably, it has been found that a slope of 10% is needed for an efficient operation of the apparatus.

Although the present invention has been explained hereinabove by way of a preferred embodiment thereof, it should be pointed out that any modifications to this preferred embodiment within the scope of the appended claims is not deemed to alter or change the nature and scope of the present invention.

The embodiments of the invention in which an exclusive property or privilege is claimed are defined as follows:

1. A screening apparatus for efficiently separating coarse material from finer material, comprising:

a frame having a lower portion for resting on a surface, and a higher portion;

a vibrating screen unit including a first material separating screen having a lower edge sloping downward with respect to said surface, and supported by said frame between said lower and higher portions;

shaking means attached onto said vibrating screen unit for shaking said vibrating screen unit;

a pivoting skip sufficiently wide for accommodating a payloader shovel, having two side arms pivotally connected onto said higher portion of said frame at a level that is sufficiently low for accommodating said payloader shovel;

at least one hydraulic cylinder having a first end connected onto said frame, and a second end connected onto said skip so that said skip can be gradually pivoted with respect to said frame, by activating said at least one cylinder from a first position in which said skip can be loaded with material into a second position in which said material loaded in said skip can be unloaded over said screen; and a vibrator unit connected onto said skip;

whereby by pivoting gradually said skip loaded with material and activating said vibrator unit, said vibrating screen unit can be gradually fed to produce an efficient screening and prevent blocking of said screening unit;

wherein said vibrator unit comprises:

a plate by which said vibrator unit is connected onto said skip;

a motor mounted onto said plate by means of a plate support;

two roll bearings mounted respectively onto said plate by means of plate supports;

a command shaft supported by said roll bearings, and connected to a shaft of said motor by means of a resilient coupling; and, two hubs fixed around said command shaft, onto which counterweights are fixed, whereby an unbalanced effect can be produced.

2. A screening apparatus according to claim 1, further comprising a programmed controller for controlling activation of said at least one cylinder, said controller comprises:

a first timer for selecting a first lifting time period of said skip;

a second timer for selecting a first rest time period of said skip that follows said first lifting period;

a third timer for selecting a second lifting time period of said skip that follows said first rest period;

a fourth time of selecting a second rest time period of said skip that follows said second lifting time period;

a fifth timer for selecting a third lifting time period that follows said second rest time period;

a sixth timer for selecting a third rest time period that follows said third lifting period;

six relays connected respectively to said timers, for controlling said at least one hydraulic cylinder upon activation of said timers, whereby said controller can be programmed by a operator that manually sets said timers.

3. A screening apparatus according to claim 2, wherein said programmed controller further comprises an antenna for receiving a remote command signal, and a decoder connected to said antenna for decoding said remote signal and producing a command signal for said controller, whereby said controller can be activated by an operator situated at a remote location.

4. A screening apparatus according to claim 1, wherein said vibrating screening unit further comprises a second material separating screen having a lower edge, sloping downward with respect to said surface, said second screen being supported by said frame underneath said first material separating screen, said second screen having meshes that are smaller than the ones of said first screen to produce a finer screening, said second screen being substantially parallel to said first screen, whereby said finer material is screened a second time by said second screen so that only finest material passes through said second screen and material that is rejected by said second screen falls at said lower edge of said second screen.

5. A screening apparatus according to claim 4, further comprising a transversal longitudinal conveyor comprising a conveying strap that is adjacent to said lower edge of said first screen so that said coarse material can fall off from said lower edge of said first screen onto said strap and be conveyed at a remote location, and a motor for activating said strap, whereby material that is rejected from said first screen can be separated from material rejected from said second screen.

6. A screening apparatus according to claim 1, further comprising rubber shock absorbers connected between said vibrating screen unit and said frame to absorb an amplifying effect resulting from a natural frequency resonance of said vibrating screen unit

7. A screening apparatus according to claim 1, wherein said at least one hydraulic cylinder is constituted of two hydraulic cylinders that have their first end connected respectively on opposite sides of said frame, and their second end connected respectively along said side arms.

8. A screening apparatus according to claim 1, wherein said vibrator unit motor is a hydraulic motor.

* * * * *